United States Patent [19]

Wacht et al.

[11] Patent Number: 5,058,752

[45] Date of Patent: Oct. 22, 1991

[54] BOOM OVERLOAD WARNING AND CONTROL SYSTEM

[75] Inventors: Raymond J. Wacht, Overland Park; Arthur D. Stukey, Olathe, both of Kans.

[73] Assignee: Simon-R.O. Corporation, Olathe, Kans.

[21] Appl. No.: 501,245

[22] Filed: Mar. 20, 1990

[51] Int. Cl.[5] ..... B66C 13/18

[52] U.S. Cl. ..... 212/150; 212/149; 212/153; 212/159; 212/231; 340/685

[58] Field of Search ..... 212/149–156, 212/159–163, 255, 260, 261, 264, 267–268, 231, 232, 238; 340/685

[56] References Cited

U.S. PATENT DOCUMENTS

| | | | |
|---|---|---|---|
| 3,819,922 | 6/1974 | Horn et al. | 212/157 |
| 3,893,093 | 7/1975 | Paredes et al. | 212/153 |
| 3,987,906 | 10/1976 | Kirsten | 340/685 |
| 4,003,482 | 1/1977 | Cheze | 340/685 |
| 4,052,602 | 10/1977 | Horn et al. | 340/685 |
| 4,516,117 | 5/1985 | Couture et al. | 212/156 |
| 4,532,595 | 7/1985 | Wilhelm | 212/153 |

FOREIGN PATENT DOCUMENTS

| | | | |
|---|---|---|---|
| 224446 | 6/1987 | European Pat. Off. | 212/153 |
| 2072343 | 9/1981 | United Kingdom | 212/153 |
| 2187432 | 9/1987 | United Kingdom | 212/157 |

*Primary Examiner*—Joseph F. Peters, Jr.
*Assistant Examiner*—R. B. Johnson
*Attorney, Agent, or Firm*—Hovey, Williams, Timmons & Collins

[57] ABSTRACT

A boom apparatus for use in lifting and transporting a payload includes a boom pivotally mounted on a support structure and including base and outer boom sections, the outer boom section being telescopically received within the base boom section and being movable axially relative to the base boom section. Sensors are provided for sensing the total length of the boom and the total moment load experienced by the boom, and an electrical warning and control circuit generates a warning signal either when the load as sensed is greater than a first predetermined value and the total length of the boom as sensed is less than a predetermined length, or when the load as sensed is greater than a second predetermined value and the total length of the boom as sensed is greater than the predetermined length, the second predetermined value of the load being less than the first predetermined value.

9 Claims, 3 Drawing Sheets

BOOM OVERLOAD WARNING AND CONTROL SYSTEM

BACKGROUND OF THE INVENTION

1. Field of the Invention

The present invention relates generally to a boom apparatus for use in lifting and transporting a payload and, more particularly, to a boom overload warning and control system for use with such a boom apparatus.

2. Discussion of the Prior Art

It is known to provide a boom apparatus comprising a plurality of relatively extensible boom sections mounted for unitary pivotal movement relative to a turret or support structure of the apparatus, and to provide appropriate means for carrying out extension of the sections and pivoting of the boom. For example, a conventional boom apparatus may include three relatively movable boom sections, a system for moving the sections axially between a retracted position and an extended position, and a hydraulic cylinder and piston extending between the boom and a support turret of the apparatus for hoisting the boom about a horizontal pivot axis between a lowered position and a raised position relative to a horizontal reference axis.

Further, such systems may employ a warning and control system in which a warning signal is generated in response to a sensed predetermined pressure level within the hydraulic cylinder which is proportional to and representative of the total moment force experienced by the boom due to the mass of the boom and any payload supported thereby. Once the predetermined pressure level is reached, the known system generates a warning and control signal which is used to indicate an overload condition of the boom apparatus and to control certain functions of the apparatus.

For example, where a hydraulic system is used to carry out the axial movement of the boom sections, the warning and control signal may be used to prevent the hydraulic system from being operable to increase the total length of the boom by only permitting the system to move the boom sections closer together. Also, the control signal may also be used to prevent the hydraulic cylinder and piston from moving to a retracted position in which the boom is lowered about its pivot axis. Both of these operations are inhibited in response to the control signal due to the potential risk of carrying out such operations when the total moment force experienced by the boom is in excess of a predetermined safe value.

In addition, if a winch is provided on the boom apparatus for lifting the payload relative to the boom, the control signal may also be used to prohibit further lifting of the payload by the winch when the pressure in the cylinder is at a level sufficient to suggest an overload condition exists. In such a condition, the winch may only be operated to lower the payload.

In this type of conventional boom overload warning and control system, the predetermined pressure level used in generating the warning and control signal represents a single moment force experienced by the boom. Thus, although the boom is capable of supporting various maximum loads depending upon the total length of the boom and the angle of the boom relative to horizontal, the warning and control system is limited to just one value. Because of this limitation in the known systems, the pressure level at which the warning and control signal is generated represents the lowest maximum moment load under which the boom apparatus is operable in order to insure that the boom apparatus never exceeds that particular overload condition.

Since this lowest maximum pressure or moment load corresponds to pressures at longer boom lengths, the utility of the boom is reduced at shorter boom lengths since the actual maximum moment load that is capable of being supported by the boom at the shorter boom lengths is never permitted to be handled by the apparatus due to actuation of the warning and control system at the relatively low pressure level.

OBJECTS AND SUMMARY OF THE INVENTION

It is an object of the present invention to provide a boom overload warning and control system which increases the utility of a boom apparatus by providing a boom overload warning and control system that automatically permits the apparatus to operate at higher pressures for shorter boom lengths and lower pressures for longer boom lengths.

In accordance with these and other objects, the boom apparatus broadly includes a boom pivotally mounted on a support structure and including a base boom section and an outer boom section, the outer boom section being telescopically received within the base boom section and being movable axially relative to the base boom section. Telescoping means is provided for moving the outer boom section axially relative to the base boom section, and boom extension sensing means are included for sensing the total length of the boom. Hoisting means pivot the boom relative to the support structure, and the apparatus also includes load sensing means for sensing the total moment load experienced by the boom. An overload warning and control means generates a warning signal in response to the boom extension sensing means and the load sensing means either when the load as sensed by the load sensing means is greater than a first predetermined value and the total length of the boom is less than a predetermined length, or when the load as sensed by the load sensing means is greater than a second predetermined value and the total length of the boom is greater than the predetermined length, the second predetermined value of the load being less than the first predetermined value.

By this construction, numerous advantages are realized. For example, by providing a "dual-phase" type of operation of a boom overload warning and control system, such that a warning signal is generated at a relatively low sensed load when the boom is in an extended position and at a relatively high sensed load when the boom is in a retracted position, it is possible to operate the boom apparatus close to the maximum capacity of the boom throughout the range of boom lengths. Little or no sacrifice is made at shorter boom lengths to insure safety at the longer boom lengths as is the case in known systems of the type discussed above.

Further, by providing control means operable in response to the boom extension sensing means and the load sensing means for inhibiting the telescoping means from moving the outer boom section axially outward relative to the base boom section and for inhibiting the hoisting means from pivoting the boom downward relative to the support structure, the boom overload warning and control system of the present invention is capable of protecting against the possibility of an operator inadvertently moving the boom so as to further increase the total moment force experienced by the boom.

In accordance with another aspect of the invention, boom angle sensing means may be provided for sensing the angle of the boom relative to a horizontal reference plane and for generating a low angle signal when the angle of the boom is less than a predetermined angle relative to the horizontal plane. The overload warning and control means is responsive to the low angle signal to generate a warning signal only when the load sensed by the load sensing means is greater than the first predetermined value regardless of the total length of the boom.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

Figure 1:
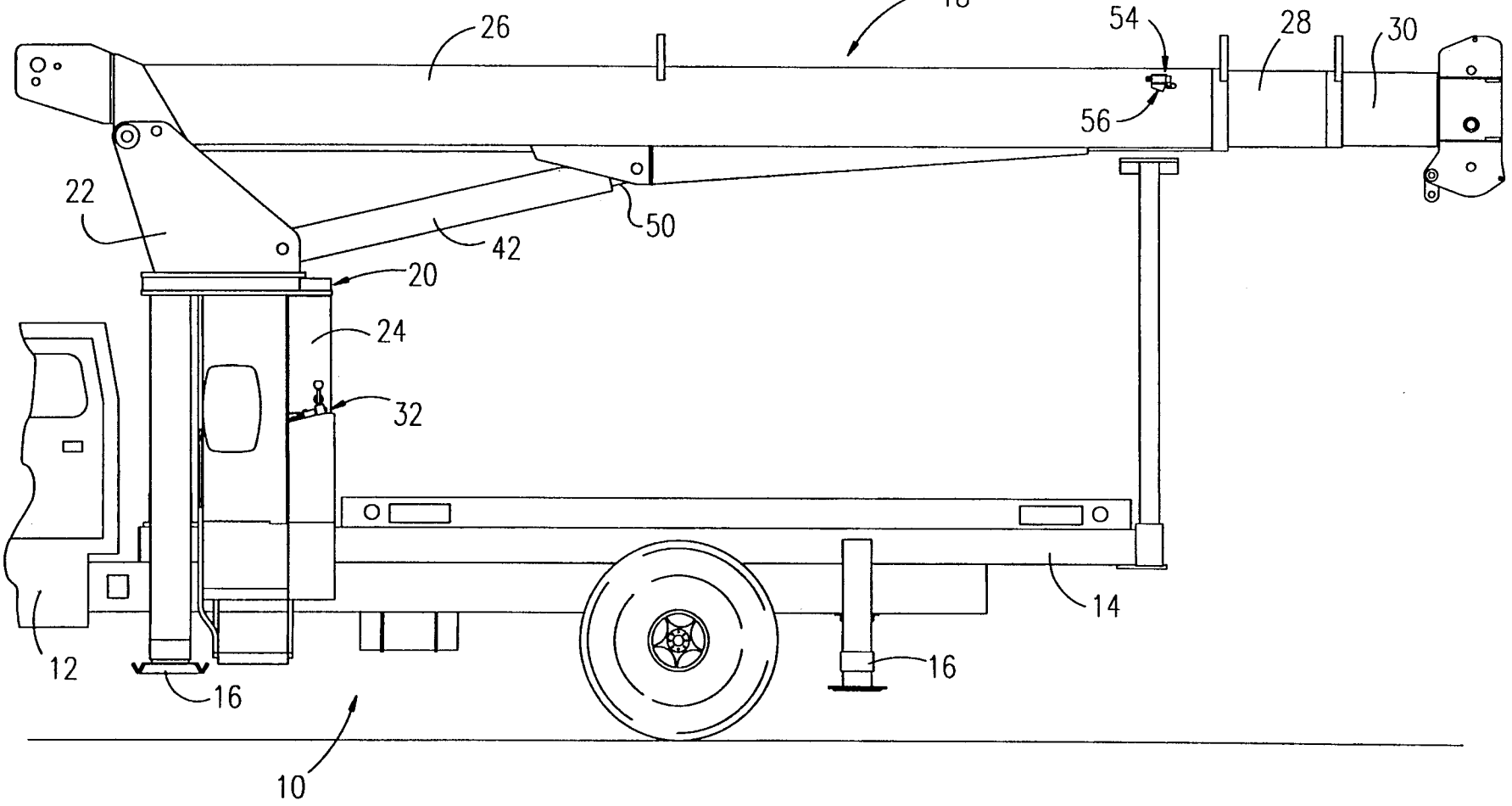
FIG. 1 is a side elevation view of a boom overload warning and control system constructed in accordance with the present invention and mounted on the flat bed of a truck.

As illustrated in FIG. 1, a boom truck 10 is shown as including a truck body 12, a bed 14 and a number of outriggers 16. A boom 18 is pivotally mounted to a support structure 20 including a turret 22 that is rotatably supported on a body 24 of the structure in a conventional manner. The boom 18 includes a base section 26, an intermediate section 28 telescopically received within the base section 26, and an outer section 30 telescopically received within the intermediate section 28. Further sections may be employed, although no such sections are illustrated in the drawing.

Figure 5:
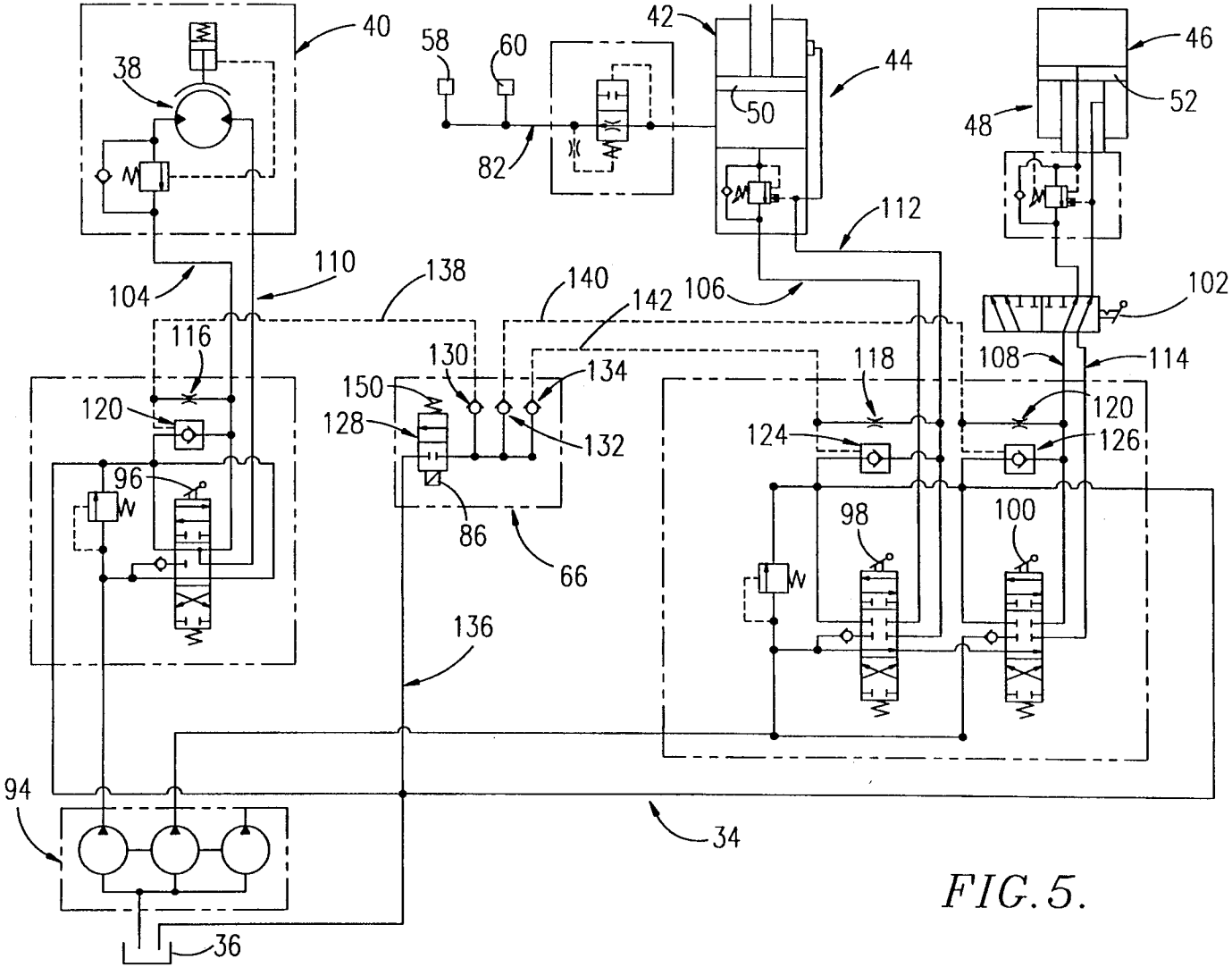
FIG. 5 is a hydraulic flow diagram illustrating the boom overload warning and control system in an non-actuated condition.

Operation of the boom is controlled manually from a control panel 32 including a number of levers operable to control the flow of hydraulic fluid within a hydraulic system 34, as designated generally in FIG. 5, between a reservoir 36 and a number of different boom operating assemblies such as a hydraulic motor 38 of a winch assembly 40, a cylinder 42 of a cylinder and piston arrangement of a boom hoist assembly 44, and a cylinder 46 of a cylinder and piston arrangement within a boom telescoping assembly 48. Other hydraulic and electric assemblies not discussed in the present specification may also be connected through the control panel but are not included as they do not make up a part of the present invention.

Returning to FIG. 1, the hydraulic cylinder 42 and piston 50 of the hoist assembly 44 are illustrated as extending between the turret 22 and the base boom section 26 so as to form a four-bar linkage arrangement which permits the boom 18 to be hoisted to any desired angle relative to the truck 10 within a range of about 10 degrees below the plane of the truck bed 14 to about 80 degrees above the plane of the bed.

The hydraulic cylinder 46 and piston 52 of the telescope assembly 48 are not sown in FIG. 1, because the assembly is disposed within the boom. However, the telescope assembly 48 may include any conventional boom section extending and retracting means capable of moving the boom sections 28, 30 axially relative to one another and the base section 26 in either a proportional or step-wise manner.

In the preferred embodiment, the cylinder and piston assembly includes means for extending the intermediate and outer boom sections 28, 30, as well as any additional boom sections, simultaneously in order that each section moves a distance proportional to the distance moved by the other sections.

Figure 2:
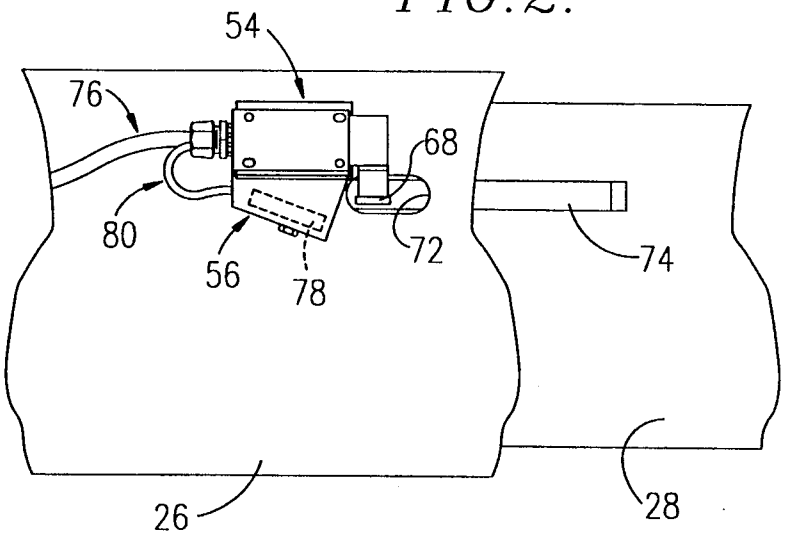
FIG. 2 is a side elevation view detailing the interaction between the limiting switch mounted on the base boom section and the cam rail mounted on the second boom section.
Figure 6:
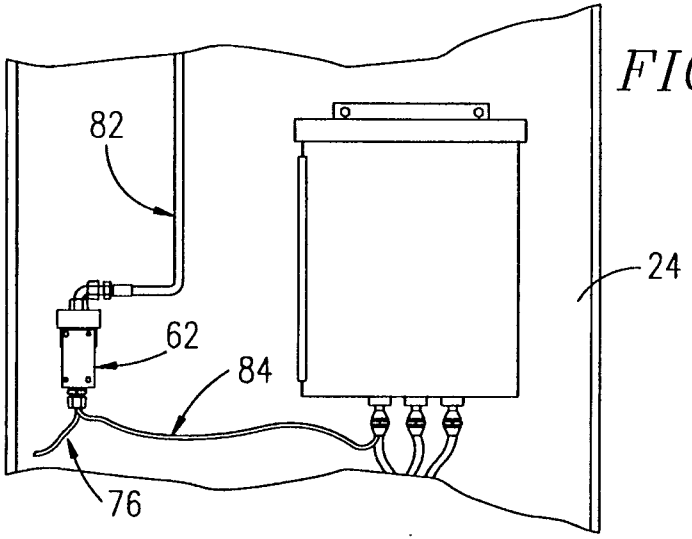
FIG. 6 is a side elevation view of the dual pressure switch component and the electrical box together with relevant hydraulic and electrical connections.
Figure 3:
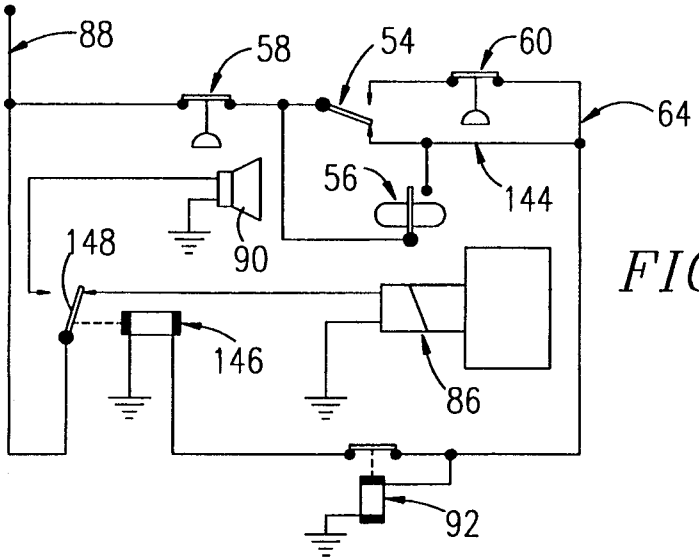
FIG. 3 is a schematic electrical circuit diagram depicting pressure switches and other electrical components of the control and warning system.

The boom overload warning and control system of the preferred embodiment of the invention is not shown in any one drawing figure, but includes a limit switch 54, and mercury switch 56, as illustrated in FIGS. 1 and 2; a pair of pressure sensitive switches 58, 60 shown separately in FIGS. 3 and 5, and depicted as a single switch assembly 62 in FIG. 6; an electrical warning and control circuit 64 illustrated in FIG. 3; and a hydraulic control circuit 66 shown in FIG. 5.

Figure 4:
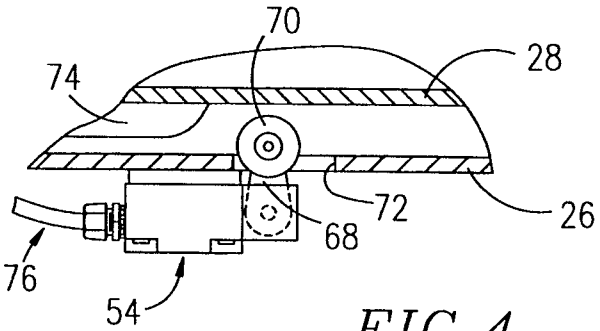
FIG. 4 is a top plan view of the portions shown in FIG. 2, with the second boom section being shown in a relatively more retracted position relative to the base boom section.

Turning first to FIG. 2, the limit switch 54 is shown as including an arm 68 pivotally mounted to the base boom section 26 for pivotal movement about an axis extending in a direction transverse to the longitudinal axis of the boom. The arm includes a roller 70 mounted on the free end thereof which extends through a slot 72 formed in the base boom section 26 and is biased toward a first limit position inward of the base section as illustrated in FIG. 4. The intermediate boom section 28 includes a cam strip 74 welded or otherwise secured to the section, the cam strip having a height sufficient to force the roller 70 outward when engaged by the strip so that the arm 68 is moved to a second limit position. A lead 76 extends from the switch 54 to the pressure sensitive switch assembly 62 mounted on the body 24 of the support structure 20.

The mercury switch 56 is also connected to the base section 26 of the boom 18 and comprises a conventional structure including a pair of normally isolated contacts (not shown), which are disposed within a small enclosure 78 in which an amount of mercury is contained. The switch 56 is oriented on the boom section at an angle of about 20 degrees to the longitudinal axis of the boom, with the contacts located at the right end of the enclosure 78 as shown in FIG. 2, so that when the boom is lowered to an angle of less than about 20 degrees, the mercury in the enclosure flows toward the contacts causing the contacts to come into electrical communication with one another and close the switch 56. An electrical lead 80 connects the mercury switch 56 with the electrical circuit 64.

The present sensitive switch assembly 62 is shown in FIG. 6, and includes the pair of pressure sensitive switches 58, 60 shown separately in FIGS. 3 and 5. The assembly 62 is connected to the hydraulic cylinder 42 via a hydraulic line 82 extending therebetween. In addition, the switch assembly 62 is connected to the limit switch 54 and the mercury switch 56 by the electrical leads 76, 80, and is connected via lead 84 to a control valve solenoid 86 of the hydraulic control assembly 66, as illustrated in FIGS. 3 and 5.

The electrical warning and control circuit 64 illustrated in FIG. 3, is a normally closed circuit including a line 88 connected to a source of power, the high pressure switch 58, the limit switch 54, the low pressure switch 60, the mercury switch 56 and the control valve solenoid 86.

In addition, a warning indicator 90, such as a horn or light, is provided in the circuit 64 to provide a warning indication to an operator when an overload condition is sensed by the warning and control system during operation of the boom apparatus. A time delay relay 92 is also included in the circuit to control the response time of the circuit so as to prevent the warning and control system from generating a warning signal when the boom 18 is experiencing only momentary overload conditions, such as when the boom bounces while carrying an acceptable sized load.

As shown in FIG. 5, the hydraulic system 34 associated with the boom apparatus includes the winch assembly 40, hoist assembly 44 and telescope assembly 48, which are connected to the reservoir 36 via lines extending between each of the assemblies and the reservoir. A pump assembly 94 including at least one pump is provided to pressurize the system, and a manually operable control lever 96, 98, 100 is associated with each of the assemblies 40, 44, 48 to permit manual control thereof. In addition, a remote function selector lever 102 may also be provided in connection with the telescope assembly 48.

The winch assembly 40, hoist assembly 44 and telescope assembly 48 each include a work line 104, 106, 108, a drain line 110, 112, 114, a bleeder orifice 116, 118, 120 and a control check valve 122, 124, 126 respectively, the operation of which is discussed in more detail below. The hydraulic control circuit 66 is included in the hydraulic system 34 and includes a control valve 128, which is spring biased toward a flow-permitting position, the control valve solenoid 86, which when actuated moves the control valve 128 to a flow-preventing position, a separate pilot check valve 130, 132, 134 for each of the winch, hoist and telescope assemblies 40, 44, 48, a drain line 136 extending between the control valve 128 and the reservoir 36, and a pilot line 138, 140, 142 extending between each of the pilot check valves 130, 132, 134 and the control check valves 122, 124, 126.

Having thus described the construction of the preferred embodiment of the overload warning and control system of the present invention, the operation of the system will now be described.

Presuming initially that the boom 18 is in a retracted position, with the roller 70 of the limit switch 54 out of engagement with the cam strip 74 as shown in FIG. 4, and with the boom hoisted to an angle of greater than about 20 degrees relative to a horizontal reference plane, the electrical circuit 64 is in the condition shown in FIG. 3.

Specifically, the high pressure switch 58 is closed, the limit switch 54 is in the first limit position connecting the high pressure switch with an electrical line 144 bypassing the low pressure switch 60, which is also closed. The mercury switch 56 is positioned between the high pressure switch 58 and the line 144, but is open. The line 144 is connected to the time-delay relay 92, which is also closed, connecting the line 144 to a control relay 146, thus closing that relay so that the entire circuit is closed. During this condition of the electrical circuit, the control valve solenoid is energized causing the control valve, illustrated in FIG. 5, to move against the bias of a spring to a flow-preventing position.

As depicted in FIG. 5, when the control valve 128 is positioned in the non-flow position, pressure develops within the pilot lines 138, 140, 142 exerting pressure on each of the control check valves 122, 124, 126 which prevents hydraulic fluid from flowing in the direction opposite to the direction of the pressure in the pilot lines. When the control check valves are in this closed position, all of the assemblies 40, 44, 48 are operable in either direction, i.e. the winch assembly 40 is operable in both the winch-up and winch-down directions, the hoist assembly 44 is operable in both the hoist-up and hoist-down directions, and the extension assembly 48 is operable in both the boom-out and boom-in directions.

Returning to FIG. 3, if the total moment load experienced by the boom, as represented in a known fashion by the pressure within the cylinder 42 of the hoist assembly 44, reaches a predetermined pressure equal or greater than the predetermined pressure setting of the high pressure switch 58, e.g. 2100 psi., the high pressure switch 58 will open causing the circuit 64 to also open. When this opening of the circuit 64 occurs, the time-delay relay 92 opens for a fixed period of time, e.g. 5 seconds, and the control relay 146 also opens, causing a contact 148 thereof to connect the indicator 90 to the power source and opening the connection between the power source and the control valve solenoid 86. Thus, a spring 150 of control valve 128 is free to move the control valve to the flow-permitting position and the pressure in the pilot lines 138, 140, 142 is relieved.

Once the pressure in lines 138, 140, 142 is relieved, flow through the control check valves 122, 124, 126 is also permitted and certain operations of the assemblies 40, 44, 48 are prevented. Specifically, when the check valves 122, 124, 116 open, the winch-up, hoist-down and telescope out operations of the assemblies 40, 44, 48 are prevented by the release of the control pressure, causing the assemblies to be operable only in directions which will tend to reduce the moment load experienced by the boom 18.

If now the boom is extended to a position sufficient to cause the roller 70 to ride up onto the cam strip 74, e.g. at boom lengths of more than about 53 feet in a boom having an adjustable length of between 25 and 63 feet, the limit switch 54 moves to the second limit position wherein the switch moves from the position shown in FIG. 3 to the alternate position in which the high pressure switch 58 is connected in series with the low pressure switch 60.

Under this condition of the system, the circuit 64 is opened whenever the load experienced by the boom 18, as sensed by sensing the pressure in the cylinder 42, reaches a value at least as great as the predetermined pressure setting of the low pressure switch 60, e.g. 1950 psi. Thus, at extended boom lengths, the overload warning and control system generates a warning signal at a lower sensed moment load than if the boom were retracted to a relatively shorter length.

When in this "low-pressure limit" mode of operation, wherein the circuit 64 provides the warning signal upon sensing the predetermined setting of the low pressure switch 60, if the boom 18 is lowered by the hoist assembly 44 to an angle of less than about 20 degrees above the horizontal plane, the mercury switch 56 closes causing the high pressure switch 58 to be connected with the line 144 bypassing the low pressure switch such that it is again necessary for the pressure in the cylinder 42 to reach the high setting before the winch-up, hoist-down and telescope-out functions of the assemblies 40, 44, 48 are deactivated.

The reason for providing this bypass of the low pressure switch 60 when the boom is at low angles, regardless of the total length of the boom, is due to the relationship that exists between the load supported on the boom 18 and the pressure sensed with the cylinder 42 at various angular positions of the boom. For example, if the same load is supported by the boom 18 while the boom is moved from a higher angular position to a lower angular position, the pressure sensed in the cylinder 42 increases. Thus, although the maximum load that can be carried by the boom at low angles of the boom is lower than the maximum possible loads at higher angular positions, the sensed pressure in the cylinder representative of the maximum, low-angle load may be higher than the pressure sensed by the low pressure switch 60 for certain constructions of the apparatus.

Accordingly, by permitting a bypass of the low pressure switch under these circumstances the utility of the boom apparatus is further augmented by increasing the range of loads capable of being lifted by the boom apparatus in the lowered positions of the boom.

Although the invention has been described with reference to the illustrated preferred embodiment, it is noted that improvements may be made and equivalents employed herein without departing from the scope of the invention as recited in the claims. For example, although the illustrated embodiment of the invention employs three boom sections, one limit switch, a mercury switch and a pair of pressure switches, it is possible to construct a device in accordance with the invention that includes more than three boom sections together with any combination of pressure switches, limit switches and angle-sensing switches in order to give any desired range of possible pressure levels at which the system will sense an overload condition for various boom lengths and angles.

What is claimed is:

1. A boom apparatus for use in lifting and transporting a payload, the boom apparatus comprising:

a support structure;

a boom pivotally mounted on the support structure and including a base boom section and an outer boom section, the outer boom section being telescopically received within the base boom section and being movable axially relative to the base boom section;

telescoping means for moving the outer boom section axially relative to the base boom section;

boom extension sensing means for sensing the total length of the boom;

hoisting means including a hydraulic cylinder and piston extending between the support structure and the boom for pivoting the boom relative to the support structure;

load sensing means for sensing the total moment load experienced by the boom, the load sensing means including pressure sensing means for sensing pressure within the cylinder, the sensed pressure being representative of the total moment load experienced by the boom, the pressure sensing means including a high pressure switch that is actuated when the pressure in the cylinder is at least at a first pressure level corresponding to a first predetermined value and a low pressure switch that is actuated when the pressure in the cylinder is at least at a second pressure level corresponding to a second predetermined value; and overload warning and control means for generating a warning signal in response to the boom extension sensing means and the load sensing means either when the load as sensed by the load sensing means is greater than the first predetermined value and the total length of the boom is less than a predetermined length, or when the load as sensed by the load sensing means is greater than the second predetermined value and the total length of the boom is greater than the predetermined length, the second predetermined value of the load being less than the first predetermined value, the overload warning and control means generating a warning signal in response to actuation of the high pressure switch when the total length of the boom is less than the predetermined length, and generating a warning signal in response to actuation of the low pressure switch when the total length of the boom is greater than the predetermined length.

2. The boom apparatus as recited in claim 1, wherein the overload warning and control means also includes control means for inhibiting the telescoping means from moving the outer boom section axially outward relative to the base boom section and for inhibiting the hoisting means from pivoting the boom downward relative to the support structure, the control means being operable either when the load as sensed by the load sensing means is greater than a first predetermined value and the total length of the boom is less than a predetermined length, or when the load as sensed by the load sensing means is greater than a second predetermined value and the total length of the boom is greater than the predetermined length, the second predetermined value of the load being less than the first predetermined value.

3. The boom apparatus as recited in claim 1, further comprising indicator means operable in response to the warning signal to indicate an overload condition of the boom.

4. The boom apparatus as recited in claim 2, further comprising winch means for lifting a payload relative to the boom, the control means including winch inhibiting means for inhibiting the winch from lifting the payload upward relative to the boom in response to the boom extension sensing means and the load sensing means.

5. The boom apparatus as recited in claim 2, further comprising boom angle sensing means for sensing the angle of the boom relative to a horizontal reference plane and for generating a low angle signal when the angle of the boom is less than a predetermined angle relative to the horizontal plane, the overload warning and control means responding to the low angle signal to generate a warning signal only when the load sensed by the load sensing means is greater than the first predetermined value regardless of the total length of the boom.

6. The boom apparatus as recited in claim 1, wherein the boom extension sensing means includes a boom-mounted switch that is actuated when the total boom length is greater than the predetermined length.

7. The boom apparatus as recited in claim 5, wherein the boom angle sensing means includes a mercury switch mounted on the boom in an orientation which permits the switch to close when the angle of the boom is less than the predetermined angle relative to the horizontal plane.

8. The boom apparatus as recited in claim 7, wherein the predetermined angle is approximately 20 degrees.

9. A boom apparatus for use in lifting and transporting a payload, the boom apparatus comprising:

a support structure;

a boom pivotally mounted on the support structure and including a base boom section and an outer boom section, the outer boom section being telescopically received within the base boom section and being movable axially relative to the base boom section;

telescoping means for moving the outer boom section axially relative to the base boom section;

boom extension sensing means for sensing the total length of the boom, the boom extension sensing means including a boom-mounted switch that is actuated when the total boom length is greater than a predetermined length, the boom-mounted switch including a pivotally mounted limit arm supported on one of either the base or outer boom section and a cam strip fixed on the other of either the base or outer boom section, the arm engaging the cam strip when the outer boom section is extended relative to the base boom section by said telescoping means to at least a position in which the total length of the boom is equal to the predetermined length;

hoisting means for pivoting the boom relative to the support structure;

load sensing means including a hydraulic circuit and an electrical circuit with a pair of switches actuated in response to respective high and low pressure conditions in said hydraulic circuit for sensing the total moment load experienced by the boom; and overload warning and control means for generating a warning signal in response to the boom extension sensing means and actuation of one of the switches of the load sensing means either when the load as sensed by the load sensing means is greater than a first predetermined value and the total length of the boom is less than a predetermined length, or when the load as sensed by the other one of said pair of switches of the load sensing means is greater than a second predetermined value and the total length of the boom is greater than the predetermined length, the second predetermined value of the load being less than the first predetermined value.

* * * * *